US011349235B2

(12) United States Patent
Jung et al.

(10) Patent No.: US 11,349,235 B2
(45) Date of Patent: May 31, 2022

(54) BOARD MATING CONNECTOR

(71) Applicant: GigaLane Co., Ltd., Hwaseong-si (KR)

(72) Inventors: Kyung Hun Jung, Hwaseong-si (KR); Hwa Yoon Song, Hwaseong-si (KR); Young Jo Kim, Hwaseong-si (KR); Yu Jin Lee, Hwaseong-si (KR); Jae Jun Lee, Hwaseong-si (KR); Sang Min Seo, Hwaseong-si (KR); Hee Seok Jung, Hwaseong-si (KR)

(73) Assignee: GIGALANE CO., LTD., Hwaseong-si (KR)

( * ) Notice: Subject to any disclaimer, the term of this patent is extended or adjusted under 35 U.S.C. 154(b) by 0 days.

(21) Appl. No.: 16/953,641

(22) Filed: Nov. 20, 2020

(65) Prior Publication Data

US 2021/0203093 A1 Jul. 1, 2021

(30) Foreign Application Priority Data

Dec. 27, 2019 (KR) ..... 10-2019-0176473

(51) Int. Cl.

| | |
|---|---|
| ***H01R 24/50*** | (2011.01) |
| ***H01R 12/71*** | (2011.01) |
| ***H01R 13/24*** | (2006.01) |
| ***H01R 13/502*** | (2006.01) |
| ***H01R 13/6594*** | (2011.01) |

(52) U.S. Cl.

CPC ..... *H01R 12/716* (2013.01); *H01R 13/2421* (2013.01); *H01R 13/2492* (2013.01); *H01R 13/502* (2013.01); *H01R 13/6594* (2013.01)

(58) Field of Classification Search

CPC ..... H01R 12/716; H01R 13/2421; H01R 13/2492; H01R 13/502; H01R 13/6594; H01R 12/91; H01R 13/17; H01R 13/6582; H01R 24/50; H01R 13/40; H01R 13/648; H01R 13/02; H01R 13/46; H01R 13/646

See application file for complete search history.

(56) References Cited

U.S. PATENT DOCUMENTS

| | | | | |
|---|---|---|---|---|
| 5,746,619 A * | 5/1998 | Harting | ..... | H01R 24/40 439/352 |
| 7,922,529 B1 * | 4/2011 | Meurer | ..... | H01R 24/50 439/578 |
| 9,559,441 B2 * | 1/2017 | Pari | ..... | H01R 13/64 |
| 9,735,531 B2 * | 8/2017 | Zhu | ..... | H01R 43/16 |

(Continued)

FOREIGN PATENT DOCUMENTS

| | | |
|---|---|---|
| CN | 110190444 B | 1/2021 |
| JP | 4428803 B2 | 12/2009 |

*Primary Examiner* — Abdullah A Riyami
*Assistant Examiner* — Nelson R. Burgos-Guntin
(74) *Attorney, Agent, or Firm* — Brundidge & Stanger, P.C.

(57) ABSTRACT

The present invention relates to a board mating connector including a first body part having a first hollow portion formed therein, a signal contact part inserted into the first hollow portion, a dielectric part positioned between the first body part and the signal contact part, a second body part which has a second hollow portion formed therein, is positioned between the dielectric part and the first body part, and is formed of a metal plate, and a ground contact part which extends upward from an upper side of the second body part and is separated into a plurality of portions by a plurality of slits to have elasticity.

13 Claims, 8 Drawing Sheets

(56) References Cited

U.S. PATENT DOCUMENTS

| | | | | |
|---|---|---|---|---|
| 9,793,660 | B2 * | 10/2017 | Holland | H01R 24/46 |
| 10,103,485 | B2 * | 10/2018 | Ikeda | H01R 4/028 |
| 10,249,968 | B2 * | 4/2019 | Dandl | H01R 12/716 |
| 10,622,765 | B2 * | 4/2020 | Song | H01R 24/50 |
| 10,804,635 | B2 * | 10/2020 | Song | H01R 24/50 |
| 10,916,902 | B2 * | 2/2021 | Maki | H01R 13/42 |
| 2002/0061670 | A1 * | 5/2002 | Havener | H01R 24/50 439/246 |
| 2008/0057782 | A1 * | 3/2008 | Berthet | H01R 24/50 439/581 |
| 2012/0295478 | A1 * | 11/2012 | Mrowka | H01R 24/50 439/578 |

* cited by examiner

BOARD MATING CONNECTOR

CROSS-REFERENCE TO RELATED APPLICATION

This application claims the benefit under 35 U.S.C. § 119 of a Korean patent application No. 10-2019-0176473 filed on Dec. 27, 2019 in the Korean Intellectual Property Office, the entire disclosure of which is hereby incorporated herein by reference.

TECHNICAL FIELD

The present invention relates to a board mating connector.

BACKGROUND

A board mating connector itself is provided as one finished electrical component.

The board mating connector transmits a radio frequency (RF) signal between a first board and a second board, such as printed circuit boards, on which signal lines are formed.

The board mating connector is fixed to the second board or fixed to another electrical component (for example, a cavity filter) configured to transmit the RF signal received from the second board to the first board, and the first board comes into contact with an upper side of the board mating connector, thereby transmitting the RF signal between the first board and the second board.

Since the board mating connector serves to transmit the RF signal between boards, the board mating connector is widely used in a mobile communication repeater (for example, a remote radio head (RRH)) through which an antenna transmits and receives the RF signal.

In order to increase the data transmission capacity of the mobile communication repeater, multiple input multiple output (MIMO) technology using a plurality of antennas is used. As a communication environment is developed beyond 5G wireless communication, the number of the antennas is increased, and as a result, the number of the board mating connectors is increased.

As described above, as the number of the board mating connectors is increased, the cost burden is increased, and thus, there is a problem in that the market requires a board mating connector that is cheaper than the conventional one.

In addition, since the board mating connector increases a mating height between the first board and the second board, there is a problem in that the market requires a board mating connector having a mating height lower than that of the conventional one.

SUMMARY

Technical Problem

The present invention is directed to providing a board mating connector.

Technical Solution

One aspect of the present invention provides the board mating connector including a first body part having a first hollow portion formed therein, a signal contact part inserted into the first hollow portion, a dielectric part positioned between the first body part and the signal contact part, a second body part which has a second hollow portion formed therein, is positioned between the dielectric part and the first body part, and is formed of a metal plate, and a ground contact part which extends upward from an upper side of the second body part and is separated into a plurality of portions by a plurality of slits to have elasticity.

The first body part may include a support portion which extends inward along a circumferential surface at a lower side of the first body part so as to be spaced apart from the signal contact part by a predetermined distance, forms a lower surface of the first body part, and supports the second body part and the dielectric part.

The board mating connector may further include a plurality of fixing leg portions which are positioned around a lower side of the signal contact part and protrude downward from a lower surface of the support portion.

The dielectric part may include a first diameter portion which has a diameter corresponding to a diameter of the second hollow portion, and a second diameter portion which has a diameter smaller than that of the first diameter portion, and a stepped portion formed by the first diameter portion and the second diameter portion may have a shape corresponding to the support portion.

The second diameter portion may protrude further downward than the support portion such that a lower side thereof is externally exposed from the support portion.

The ground contact part may include an elastic portion extending upward from an upper side of the second body part so as to be further inclined inward or outward beyond an inclination of the second body part.

The ground contact part may include a contact portion which is bent to extend from an upper side of the elastic portion in a direction opposite to a direction in which the elastic portion extends, and has a curved surface formed at a bent portion thereof.

The ground contact part may include a restriction portion which is positioned between the elastic portion and the second body part and includes a portion bent to extend outward from the second body part and a portion bent to extend inward toward the second body part.

The board mating connector may further include a first cover portion which extends outward along a circumferential surface at an upper side of the first body part, wherein an upper surface of the first cover portion and a lower surface of the restriction portion are positioned to face each other.

The board mating connector may further include a second cover portion which extends upward from an outer side of the first cover portion, wherein an inner surface of the second cover portion and an outer surface of the restriction portion are positioned to face each other.

The dielectric part may include a groove recessed along a circumferential surface of the dielectric part, and the second body part may include a plurality of latch portions which protrude along a circumferential surface of the second body part so as to be inserted into the groove.

The board mating connector may further include a plurality of fixing portions which extend inward along a circumferential surface of a lower side of the second body part, wherein the fixing portion is positioned between the support portion and the dielectric part.

The fixing portions may be positioned such that a pair of the fixing portions facing each other are symmetrical.

Advantageous Effects

First, there is an effect of reducing the price of a board mating connector.

Next, there is an effect of reducing a mating height of the board mating connector.

BRIEF DESCRIPTION OF DRAWINGS

Exemplary embodiments of the present disclosure will be described with reference to the accompanying drawings described below, and similar reference numerals denote similar elements, but the present disclosure is not limited thereto.

DETAILED DESCRIPTION

Hereinafter, exemplary embodiments of the present invention will be described in detail with reference to the accompanying drawings so as to be easily embodied by those of ordinary skill in the art.

The present invention may be implemented in various forms and is not limited to the following exemplary embodiments.

A board mating connector itself is provided as one finished electrical component.

The board mating connector transmits a radio frequency (RF) signal between a first board and a second board, such as printed circuit boards, on which signal lines are formed.

The board mating connector is fixed to the second board or fixed to another electrical component (for example, a cavity filter) configured to transmit the RF signal received from the second board to the first board, and the first board comes into contact with an upper side of the board mating connector, thereby transmitting the RF signal between the first board and the second board.

Since the board mating connector serves to transmit the RF signal between boards, the board mating connector is widely used in a mobile communication repeater (for example, a remote radio head (RRH)) through which an antenna transmits and receives the RF signal.

In order to increase the data transmission capacity of the mobile communication repeater, multiple input multiple output (MIMO) technology using a plurality of antennas is used. As a communication environment is developed beyond 5G wireless communication, the number of the antennas is increased, and as a result, the number of the board mating connectors is increased.

As described above, as the number of the board mating connectors is increased, the cost burden is increased, and thus, there is a problem in that the market requires a board mating connector that is cheaper than the conventional one.

In addition, since the board mating connector increases a mating height between the first board and the second board, there is a problem in that the market requires a board mating connector having a mating height lower than that of the conventional one.

Figure 1:
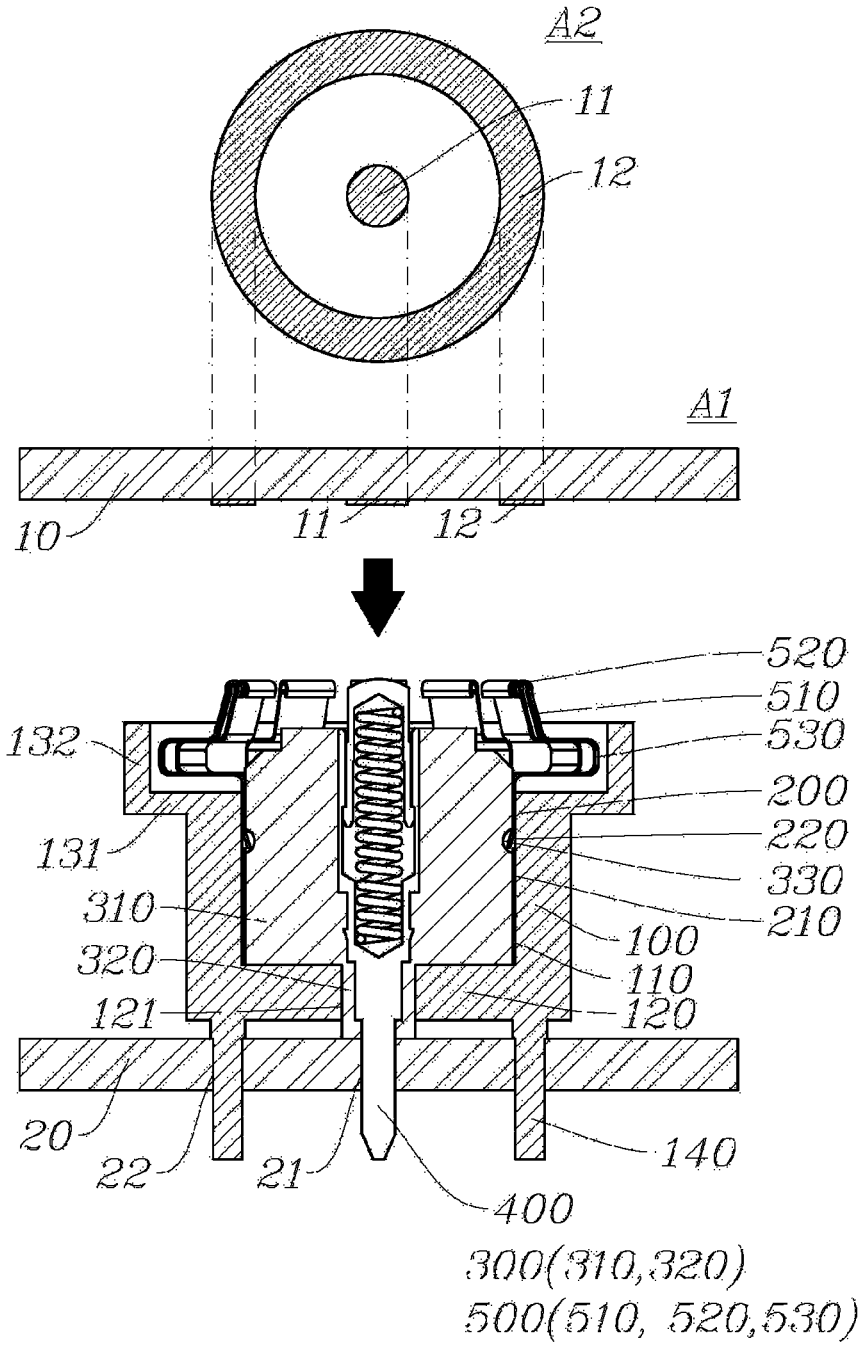
FIG. 1 is a cross-sectional view of a board mating connector according to an exemplary embodiment of the present invention.
Figure 2:
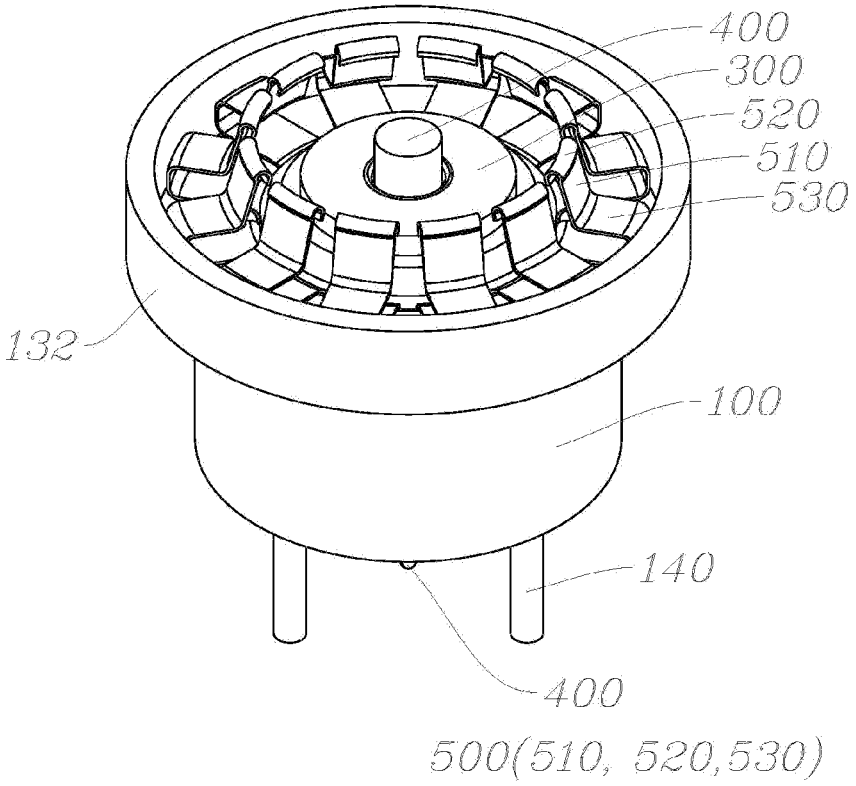
FIG. 2 is an external view of the board mating connector according to the exemplary embodiment of the present invention.
Figure 3:
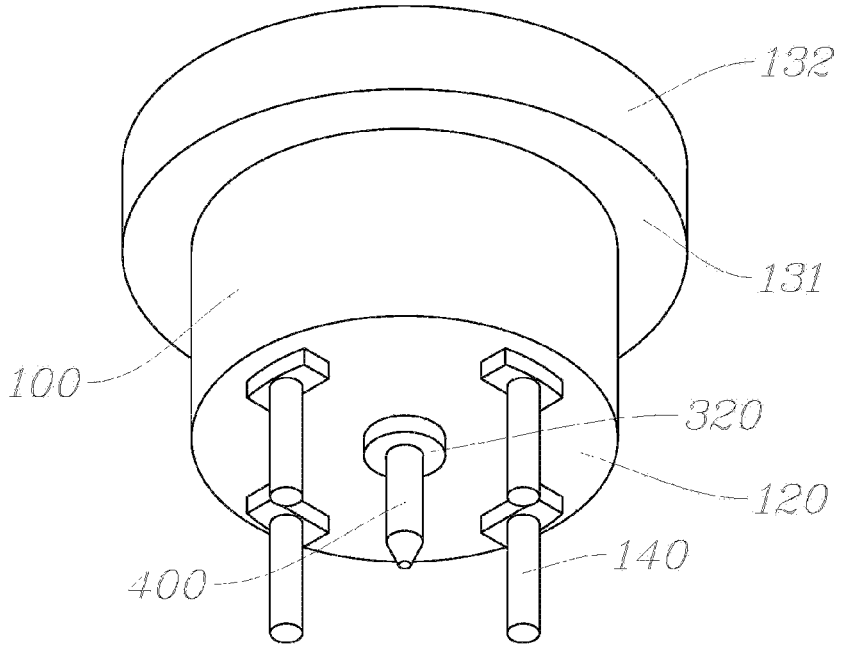
FIG. 3 is an external view of FIG. 2 viewed in a different direction.

In order to solve the problems, as shown in FIGS. 1 to 3, a board mating connector according to an exemplary embodiment of the present invention may include a first body part 100, a signal contact part 400, a dielectric part 300, a second body part 200, and a ground contact part 500.

The first body part 100 may be made of a conductive material, and a first hollow portion 110 may be formed therein.

The signal contact part 400 may be made of a conductive material and may be inserted into the first hollow portion 110.

The signal contact part 400 may be a pogo pin in which a spring is embedded.

The dielectric part 300 may be made of a non-conductive material and may be positioned between the first body part 100 and the signal contact part 400.

The second body part 200 may be made of a conductive material, and a second hollow portion 210 may be formed therein.

The second body part 200 may be positioned between the dielectric part 300 and the first body part 100.

The second body part 200 may be inserted into the first hollow portion 110 of the first body part 100 so that a region of the first hollow portion 110 and a region of the second hollow portion 210 may overlap each other.

The second body part 200 may be formed by rolling a metal plate into a cylindrical shape or may be formed through a pressing process (for example, a deep drawing process).

Since the second body part 200 is formed of the metal plate and is thin, the first body part 100 adjacent to the second body part 200 may reinforce a thickness of the second body part 200.

As described above, the first body part 100 has an effect of reinforcing the thickness of the second body part 200.

A1 of FIG. 1 is a cross-sectional view of a first board 10, and A2 of FIG. 1 is a view illustrating a signal electrode 11 and a ground electrode 12 on a lower surface of the first board 10.

As shown in A1 and A2 of FIG. 1, the signal electrode 11 and the ground electrode 12 may be formed on the first board 10.

The signal electrode 11 may come into contact with an upper side of the signal contact part 400, and the ground electrode 12 may come into contact with an upper side of the ground contact part 500.

Signal lines of the first board 10 may be electrically connected to the signal contact part 400 and the ground contact part 500 through the signal electrode 11 and the ground electrode 12.

The ground contact part 500 may extend upward from an upper side of the second body part 200 and may be separated into a plurality of portions by a plurality of slits to have elasticity.

Figure 4:
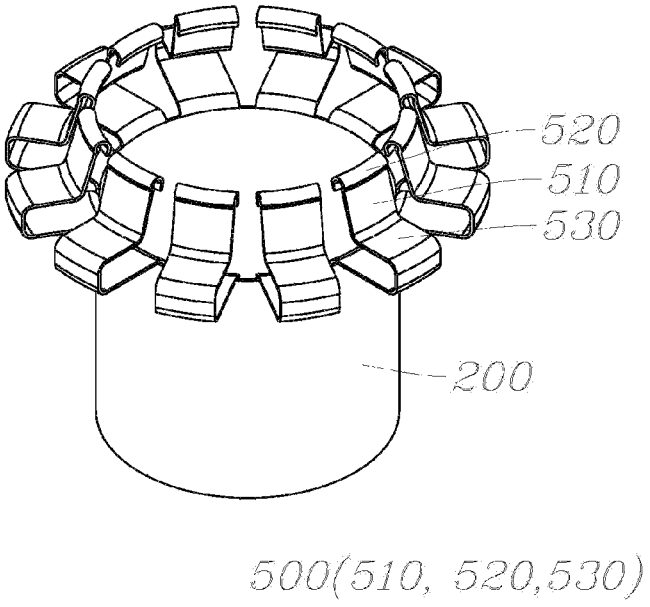
FIG. 4 is an external view of a ground contact part according to the exemplary embodiment of the present invention.

As shown in FIG. 4, the ground contact part 500 may be formed to have elasticity by bending a metal plate.

Since the ground contact part 500 is formed to have elasticity by bending the metal plate, the ground contact part 500 may not require a separate component (for example, a spring) for providing elasticity.

As described above, since the ground contact part 500 does not require the separate component for providing elasticity, there is an effect of reducing the price of the board mating connector.

The ground contact part 500 may come into direct contact with the ground electrode 12 of the first board 10 without needing to be coupled with a separate connector.

As described above, since the ground contact part 500 does not need to be coupled with the separate connector, there is an effect of reducing a mating height of the board mating connector.

Describing the exemplary embodiment in detail, as shown in FIGS. 1 and 3, the first body part 100 may include a support portion 120.

The support portion 120 extends inward along a circumferential surface at a lower side of the first body part 100 and has a support portion hole 121 formed therein to be spaced apart from the signal contact part 400 by a predetermined distance. The support portion 120 may form a lower surface of the first body part 100 and may support the second body part 200 and the dielectric part 300.

Describing the exemplary embodiment in detail, as shown in FIGS. 1 to 3, fixing leg portions 140 may be provided.

The plurality of fixing leg portions 140 may be positioned around a lower side of the signal contact part 400 and may protrude downward from a lower surface of the support portion 120.

As shown in FIG. 1, a signal hole 21 and a ground hole 22, which are holes vertically passing through a second board 20, may be formed in the second board 20.

The lower side of the signal contact part 400 may be inserted into and soldered in the signal hole 21, and at least a portion of the fixing leg portion 140 may be inserted into and soldered in the ground hole 22.

For example, the signal contact part 400 and the fixing leg portion 140 may be soldered in the signal hole 21 and the ground hole 22 through a surface mounter technology (SMT) process.

Signal lines of the second board 20 may be electrically connected to the signal contact part 400 and the fixing leg portion 140 through the signal hole 21 and the ground hole 22.

Describing the exemplary embodiment in detail, as shown in FIG. 1, the dielectric part 300 may include a first diameter portion 310 and a second diameter portion 320.

The first diameter portion 310 may have a diameter corresponding to a diameter of the second hollow portion 210.

The second diameter portion 320 may have a diameter that corresponds to a diameter of the support portion hole 121 and is smaller than the diameter of the first diameter portion 310.

A stepped portion is formed between the first diameter portion 310 and the second diameter portion 320 due to the different diameters thereof. The stepped portion may have a shape corresponding to the support portion 120.

The second diameter portion 320 may have the diameter corresponding to the diameter of the support portion hole 121 and thus inserted into the support portion hole 121, and the first diameter portion 310 may have the diameter greater than the diameter of the support portion hole 121 and thus caught by the support portion 120, thereby restricting the dielectric part 300 from being excessively inserted into the support portion hole 121.

As described above, the first diameter portion 310 and the second diameter portion 320 have an effect of being able to restrict the dielectric part 300 from being excessively inserted into the support portion hole 121.

The second diameter portion 320 may have the diameter corresponding to the diameter of the support portion hole 121, and thus, an outer surface of the second diameter portion 320 may be in close contact with an inner surface of the support portion 120, thereby fixing the dielectric part 300 so as to not be moved.

As described above, the second diameter portion 320 has an effect of being able to fix the dielectric part 300 so as to not be moved.

Describing the exemplary embodiment in detail, as shown in FIGS. 1 and 3, the second diameter portion 320 may protrude further downward than the support portion 120 such that a lower side thereof is externally exposed from the support portion 120.

One side of the second diameter portion 320, which protrudes further downward from the first body part 100 and is externally exposed, is positioned between the support portion 120 and the lower side of the signal contact part 400 inserted into the signal hole 21 of the second board 20 to serve as a barrier, thereby restricting lead or flux from spreading to the upper side of the signal contact part 400 along the lower side of the signal contact part 400 in a process of soldering the lower side of the signal contact part 400.

As described above, the second diameter portion 320 has an effect of restricting lead or flux from spreading to the upper side of the signal contact part 400 along the lower side of the signal contact part 400.

Describing the exemplary embodiment in detail, as shown in FIGS. 1, 2, and 4, the ground contact part 500 may include an elastic portion 510.

The elastic portion 510 may extend upward from the upper side of the second body part 200 so as to be further inclined inward or outward beyond an inclination of the second body part 200.

For example, the elastic portion 510 may have an inclination of 0° to 180° by being further inclined inward by an inclination of −90° or less or outward by +90° or less beyond an inclination of 90° of the second body part 200.

The elastic portion 510 may have elasticity so as to be inclined further in a direction, in which the elastic portion 510 is inclined, when the ground electrode 12 comes into contact with the upper side of the ground contact part 500.

As described above, the elastic portion 510 has an effect of having elasticity.

Describing the exemplary embodiment in detail, as shown in FIGS. 1, 2, and 4, the ground contact part 500 may include a contact portion 520.

The contact portion 520 is bent to extend from an upper side of the elastic portion 510 in a direction opposite to a direction in which the elastic portion 510 extends, and a curved surface may be formed at a bent portion thereof.

Describing the exemplary embodiment in detail, as shown in FIGS. 1, 2, and 4, the ground contact part 500 may include a restriction portion 530.

The restriction portion 530 may be positioned between the elastic portion 510 and the second body part 200 and may include a portion bent to extend outward and a portion bent to extend inward to have elasticity.

As described above, since the restriction portion 530 includes the portions bent outward and inward to have elasticity, there is an effect of further adding a component for providing elasticity in addition to the elasticity of the elastic portion 510.

Describing the exemplary embodiment in detail, as shown in FIGS. 1 and 3, a first cover portion 131 may be provided.

The first cover portion 131 may extend outward along a circumferential surface at an upper side of the first body part 100.

An upper surface of the first cover portion 131 and a lower surface of the restriction portion 530 may be positioned to face each other.

When the ground electrode 12 comes into contact with the upper side of the ground contact part 500 and is excessively inclined, the lower surface of the restriction portion 530 may come into contact with the upper surface of the first cover portion 131, thereby restricting the elastic portion 510 from being excessively inclined.

As described above, the first cover portion 131 has an effect of restricting the elastic portion 510 from being excessively inclined.

Describing the exemplary embodiment in detail, as shown in FIGS. 1 to 3, a second cover portion 132 may be provided.

The second cover portion 132 may extend upward from an outer side of the first cover portion 131.

An inner surface of the second cover portion 132 and an outer surface of the restriction portion 530 may be positioned to face each other.

The second cover portion 132 may be formed to surround the restriction portion 530 to prevent the restriction portion 530 from being damaged due to external factors.

As described above, the second cover portion 132 has an effect of preventing the restriction portion 530 from being damaged.

In FIGS. 1 to 3, the board mating connector may include the first cover portion 131 and the second cover portion 132 described above, which extend from the first body part 100, but the present invention is not limited thereto. The first cover portion 131 and the second cover portion 132 may be excluded, and the board mating connector may include only the first body part 100. Alternatively, the second cover portion 132 may be excluded and the board mating connector may include only the first body part 100 and first cover portion 131.

Describing the exemplary embodiment in detail, as shown in FIG. 1, the dielectric part 300 may include a groove 330, and the second body part 200 may include a latch portion 220.

The groove 330 may be recessed along a circumferential surface of the dielectric part 300.

A plurality of latch portions 220 may protrude along a circumferential surface of the second body part 200 so as to be inserted into the groove 330.

Figure 5:
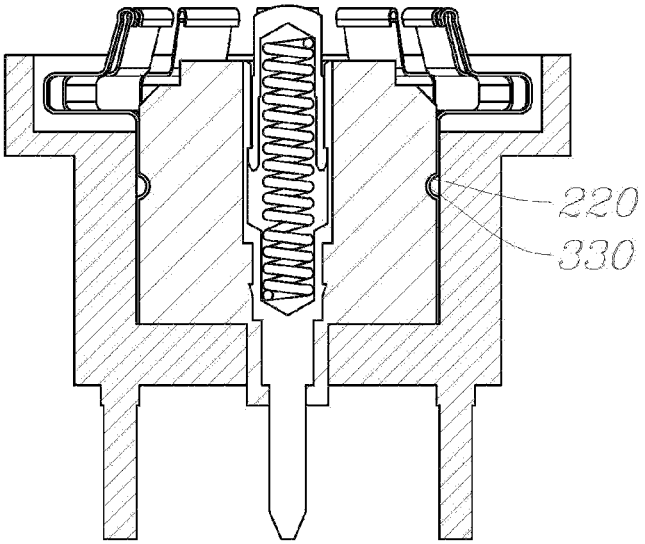
FIG. 5 is a cross-sectional view of a latch portion of the board mating connector according to the exemplary embodiment of the present invention.

For example, the latch portion 220 may be formed by folding a portion of the second body part 200 inward as shown in FIG. 1 or may be formed by pressing the second body part 200 to form a protrusion so as to protrude inward from the second body part 200 as shown in FIG. 5.

The latch portion 220 may be caught in the groove 330, thereby preventing the second body part 200 from being separated from the dielectric part 300.

As described above, the latch portion 220 has an effect of preventing the second body part 200 from being separated from the dielectric part 300.

Figure 7:
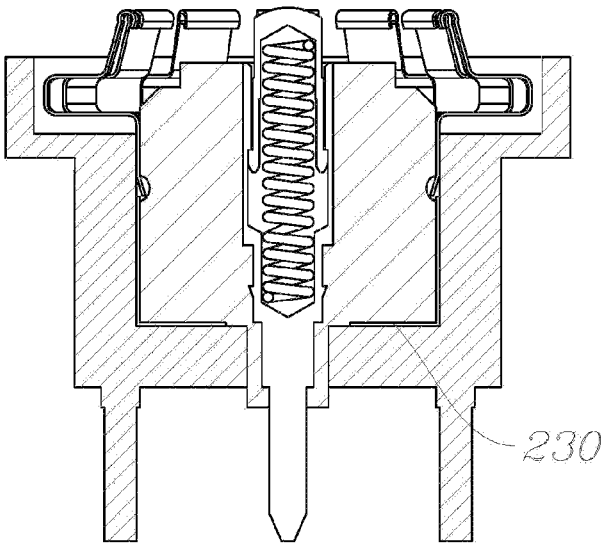
FIG. 7 is a cross-sectional view of a fixing portion of the board mating connector according to the exemplary embodiment of the present invention.
Figure 8:
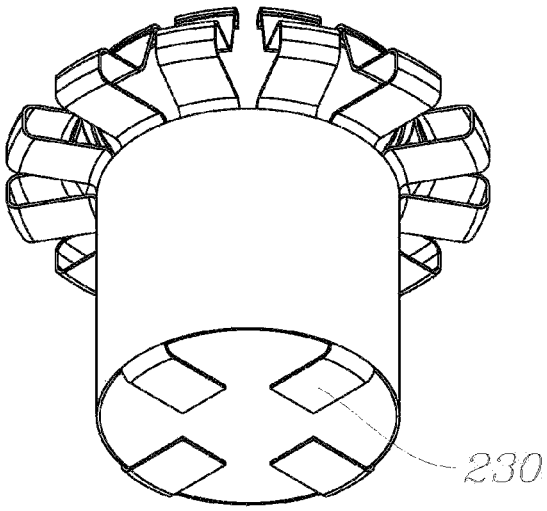
FIG. 8 is a cross-sectional view of a fixing portion of a ground contact part according to the exemplary embodiment of the present invention.

Describing the exemplary embodiment in detail, as shown in FIGS. 7 and 8, a fixing portion 230 may be provided.

A plurality of fixing portions 230 may extend inward along a circumferential surface at a lower side of the second body part 200 so as to be spaced apart from the signal contact part 400 by a predetermined distance.

The fixing portion 230 may be positioned between the support portion 120 and the dielectric part 300.

The fixing portions 230 may be positioned such that a pair of fixing portions 230 facing each other are symmetrical.

Figure 6:
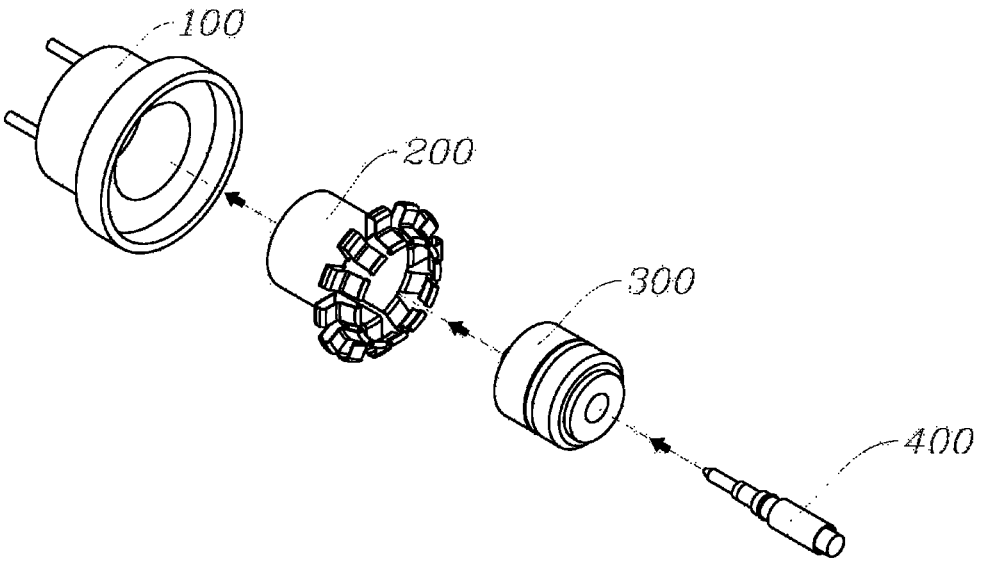
FIG. 6 is an assembly view of the board mating connector according to the exemplary embodiment of the present invention.

As shown in an assembly view of the board mating connector shown in FIG. 6, the second body part 200 may be inserted into the first body part 100, and the dielectric part 300 into which the signal contact part 400 is inserted may be inserted into the first body part 100.

In this case, in a process of inserting the dielectric part 300 into the first body part 100, the second body part 200 may be pushed out of the first hollow portion 110 by the pressure at which the dielectric part 300 is inserted.

However, since the fixing portion 230 catches the dielectric part 300, the fixing portion 230 can prevent the second body part 200 from being pushed out.

As described above, the fixing portion 230 has an effect of preventing the second body part 200 from being pushed out.

The fixing portion 230 catches the dielectric part 300, and thus, the fixing portion 230 and the second body part 200 connected to the fixing portion 230 are inserted into the first hollow portion 110 together to a position at which the dielectric part 300 is inserted into the first hollow portion 110. Accordingly, a contact position of the ground contact part 500 can be prevented from being raised due to the second body part 200 being less inserted into the first hollow portion 110.

As described above, the fixing portion 230 has an effect of preventing the contact position of the ground contact part 500 from being raised.

The fixing portions 230 may be positioned such that the pair of fixing portions 230 facing each other are symmetrical, and thus, the fixing portions 230 may uniformly catch the dielectric part 300 without bias to either side so that the second body part 200 may be inserted into the first hollow portion 110. Accordingly, the contact position of the ground contact part 500 can be prevented from tilting due to the biased insertion of the second body part 200 into the first hollow portion 110.

As described above, the fixing portion 230 has an effect of preventing the contact position of the ground contact part 500 from tilting.

Although the present invention have been described with reference to the exemplary embodiments, the present invention is not limited thereto and may be embodied in many different forms within the appended claims.

[DESCRIPTION OF REFERENCE NUMERALS]

| | |
|---|---|
| 10: first board | 11: signal electrode |
| 12: ground electrode | 20: second board |
| 21: signal hole | 22: ground hole |
| 100: first body part | 110: first hollow portion |
| 120: support portion | 121: support portion hole |
| 131: first cover portion | 132: second cover portion |
| 140: fixing leg portion | 200: second body part |
| 210: second hollow portion | 220: latch portion |
| 230: fixing portion | 300: dielectric part |
| 310: first diameter portion | 320: second diameter portion |
| 330: groove | 400: signal contact part |
| 500: ground contact part | 510: elastic portion |
| 520: contact portion | 530: restriction portion |

We claim:

1. A board mating connector, comprising:

a first body part having a first hollow portion formed therein;

a signal contact part inserted into the first hollow portion;

a dielectric part positioned between the first body part and the signal contact part;

a second body part which has a second hollow portion formed therein, is positioned between the dielectric part and the first body part, and is formed of a metal plate;

a ground contact part which extends upward from an upper side of the second body part and is separated into a plurality of portions by a plurality of slits to have elasticity; and a plurality of fixing portions which extend inward from a lower side of the second body part and along a circumferential surface of the lower side of the second body part, wherein each of the plurality of fixing portions is positioned between the support portion and the dielectric part.

2. The board mating connector of claim 1, wherein the first body part includes a support portion which extends inward along a circumferential surface at a lower side of the first body part so as to be spaced apart from the signal contact part by a predetermined distance, forms a lower surface of the first body part, and supports the second body part and the dielectric part.

3. The board mating connector of claim 2, further comprising a plurality of fixing leg portions which are positioned around a lower side of the signal contact part and protrude downward from a lower surface of the support portion.

4. The board mating connector of claim 2, wherein the dielectric part includes a first diameter portion which has a diameter corresponding to a diameter of the second hollow portion, and a second diameter portion which has a diameter smaller than that of the first diameter portion, and a stepped portion formed by the first diameter portion and the second diameter portion has a shape corresponding to the support portion.

5. The board mating connector of claim 4, wherein the second diameter portion protrudes further downward than the support portion such that a lower side thereof is externally exposed from the support portion.

6. The board mating connector of claim 1, wherein the ground contact part includes an elastic portion extending upward from an upper side of the second body part so as to be further inclined inward or outward beyond an inclination of the second body part.

7. The board mating connector of claim 6, wherein the ground contact part includes a contact portion, which is bent to extend from an upper side of the elastic portion in a direction opposite to a direction in which the elastic portion extends, and has a curved surface formed at a bent portion thereof.

8. The board mating connector of claim 7, wherein the ground contact part includes a restriction portion which is positioned between the elastic portion and the second body part and includes a portion bent to extend outward from the second body part and a portion bent to extend inward toward the second body part.

9. The board mating connector of claim 8, further comprising a first cover portion which extends outward along a circumferential surface at an upper side of the first body part, wherein an upper surface of the first cover portion and a lower surface of the restriction portion are positioned to face each other.

10. The board mating connector of claim 9, further comprising a second cover portion which extends upward from an outer side of the first cover portion, wherein an inner surface of the second cover portion and an outer surface of the restriction portion are positioned to face each other.

11. The board mating connector of claim 1, wherein the dielectric part includes a groove recessed along a circumferential surface of the dielectric part, and the second body part includes a plurality of latch portions which protrude along a circumferential surface of the second body part so as to be inserted into the groove.

12. The board mating connector of claim 1, wherein the fixing portions are positioned such that a pair of the fixing portions facing each other are symmetrical.

13. A board mating connector, comprising:

a first body part having a first hollow portion formed therein;

a signal contact part inserted into the first hollow portion;

a dielectric part positioned between the first body part and the signal contact part;

a second body part which has a second hollow portion formed therein, is positioned between the dielectric part and the first body part, and is formed of a metal plate; and a ground contact part which extends upward from an upper side of the second body part and is separated into a plurality of portions by a plurality of slits to have elasticity, wherein the dielectric part includes a groove recessed along a circumferential surface of the dielectric part, and the second body part includes a plurality of latch portions which protrude from a portion of the second body part and along a circumferential surface of the second body part so as to be inserted into the groove.

* * * * *